US010631676B2

(12) United States Patent
Hakim

(10) Patent No.: US 10,631,676 B2
(45) Date of Patent: Apr. 28, 2020

(54) TWO-PIECE SPILL PROOF OPEN CUP

(71) Applicant: Jack Allen Hakim, Monroe, LA (US)

(72) Inventor: Jack Allen Hakim, Monroe, LA (US)

( * ) Notice: Subject to any disclaimer, the term of this patent is extended or adjusted under 35 U.S.C. 154(b) by 283 days.

(21) Appl. No.: 15/602,772

(22) Filed: May 23, 2017

(65) Prior Publication Data

US 2018/0279815 A1 Oct. 4, 2018

Related U.S. Application Data

(60) Provisional application No. 62/477,825, filed on Mar. 28, 2017.

(51) Int. Cl.

| | |
|---|---|
| ***A47G 19/22*** | (2006.01) |
| ***B65D 1/40*** | (2006.01) |
| ***B65D 43/02*** | (2006.01) |
| ***B65D 47/32*** | (2006.01) |
| ***B65D 25/28*** | (2006.01) |

(52) U.S. Cl.

CPC ..... *A47G 19/2272* (2013.01); *B65D 1/40* (2013.01); *B65D 25/2802* (2013.01); *B65D 43/022* (2013.01); *B65D 47/32* (2013.01); *B65D 2525/283* (2013.01); *B65D 2543/005* (2013.01); *B65D 2543/00046* (2013.01); *B65D 2543/00231* (2013.01); *B65D 2543/00296* (2013.01); *B65D 2543/00851* (2013.01)

(58) Field of Classification Search

CPC ..... A47G 19/2272; A47G 19/22; B65D 1/40; B65D 25/2802; B65D 43/022; B65D 47/32; B65D 2525/283; B65D 2543/00046; B65D 2543/00231; B65D 2543/00296; B65D 2543/005; B65D 2543/00851

USPC ..... 220/212.5, 254.1, 378, 713, 592.17, 711, 220/714, 719, 231

See application file for complete search history.

(56) References Cited

U.S. PATENT DOCUMENTS

| | | | | |
|---|---|---|---|---|
| 9,215,942 | B2 * | 12/2015 | Bodum | A47G 19/2272 |
| 2013/0233870 | A1 * | 9/2013 | Miller | A47G 19/22 220/719 |
| 2015/0173540 | A1 * | 6/2015 | Albers | B65B 3/045 220/715 |

* cited by examiner

*Primary Examiner* — Elizabeth J Volz

(57) ABSTRACT

A two-piece spill proof open cup is disclosed comprising a container suitable for holding liquids, such as a beverage, and a lid. The container has a sidewall, a neck adjacent the sidewall and an opening defined by the neck. The neck has a flange along an edge of the neck and a plurality of posts adjacent the flange. The lid is adapted to fasten to the container. The lid has an upper surface external to the two-piece spill proof open cup and a lower surface internal to the two-piece spill proof open cup. The lid also has a flap, a lid body with a vent, a hinge connecting the flap to the lid body, a handle on the upper surface and a bead having channels. The bead is integrated into the lower surface. The lid flap is adapted to form a liquid tight seal between the lid and container.

20 Claims, 9 Drawing Sheets

TWO-PIECE SPILL PROOF OPEN CUP

CROSS REFERENCE TO RELATED APPLICATIONS

This application claims the benefit of U.S. provisional patent application Ser. No. 62/477,825, filed Mar. 28, 2017, which is incorporated herein by reference in its entirety.

FIELD OF DISCLOSURE

The present disclosure relates generally to cups and other drinking vessels and, more particularly, to a two-piece spill proof open cup.

BACKGROUND

Since the invention of the cup, humans have been plagued with the problem of spills. Thus, the need for a no-spill or spill proof cup is well known in the art. One approach has been to provide a cup lid with a spout and a valve controlling the flow of liquid through the spout. An example of a successful prior art approach to a spill proof cup is U.S. Pat. No. 6,321,931. Other examples of cups with spouts are disclosed in U.S. Pat. Nos. 6,102,245 and 6,116,457. A disadvantage of these approaches is that they are not open cup designs as the user can only drink from the spout. In an open cup, the user can drink from any position along the rim of the cup. A problem with prior art spill proof cups arises when the user cannot see the cup while attempting to drink, for instance while driving an automobile. In those instances, the user often times has to divert his or her attention from the task at hand to properly orient the cup so that the spout aligns properly with the user's mouth. This has created a need for spill proof cups that can be used like an open cup. Various prior art solutions have been provided with openings along the periphery or rim of the cup that together with a valve provide a spill proof cup that permits the user to drink from any location along the rim or edge of the cup lid. Examples of such cups are shown in U.S. Pat. Nos. 5,890,619; 6,202,877; 7,549,556; 8,025,178; 8,418,876; 8,453,870; 9,149,138 and 9,241,588. These prior patents suffer from a number of deficiencies. For example, a number of the cups disclosed in these prior patents have complex valve structures that are hard to keep clean and maintain in a sanitary condition. Another problem with prior art cups is they do not provide tight seals and can leak. Another problem with various prior art cups is that they are not ergonomic and can be uncomfortable to use. Another problem with cups disclosed in the prior art is that they are uncomfortable if used as a regular open cup with the lid removed. Another problem with some of the cups disclosed in these prior patents arises when the cup is near empty. In order to work properly when the cup is near empty, the cup has to be pointed nearly straight down creating an awkward drinking angle. Another deficiency of the cups disclosed in these prior patents is that they have numerous parts and can be difficult to assemble. This is a problem both in the original assembly by the manufacture and by the user after the cup has been cleaned. Thus, heretofore unaddressed needs exist in the industry to address the aforementioned deficiencies and inadequacies.

SUMMARY

In one embodiment, a two-piece spill proof open cup is disclosed comprising a container and a lid. The container is suitable for holding liquids and has a sidewall, a neck adjacent the sidewall and an opening defined by the neck. The neck has a flange along an edge of the neck and a plurality of posts adjacent the flange. The lid is adapted to fasten to the container. The lid has an upper surface external to the two-piece spill proof open cup and a lower surface internal to the two-piece spill proof open cup. The lid also has a flap, a lid body with a vent, a hinge connecting the flap to the lid body, a handle on the upper surface, and a bead having channels. The bead is integrated into the lower surface. In another embodiment, the container has an inside diameter and the lid has an outside diameter and the outside diameter is slightly larger than the inside diameter. In another embodiment, the flap is constructed so that it is loaded against the flange. In another embodiment, the lid is constructed of an elastomeric material. In another embodiment, the container is constructed of a thermoplastic material. In another embodiment, the lid is constructed of silicone.

In another embodiment, a two-piece spill proof open cup comprises a lid and a container. The lid has an upper surface, a lower surface, a flap, a lid body, a hinge connecting the flap to the lid body, a handle on the upper surface, and a bead having channels wherein the bead is integrated into the lower surface. The container is suitable for holding liquids and has a sidewall, a neck adjacent the sidewall and an opening defined by the neck. The sidewall has a seat and a shoulder adjacent the seat. The seat is adapted to receive the bead. The neck has a flange along an edge of the neck and a plurality of posts adjacent the flange. The posts are positioned along the edge of the neck so that the hinge rests on the posts when the lid is attached to the container. In another embodiment, the lid body further comprises a vent. In another embodiment, the flap is constructed so that it is loaded against the flange.

In another embodiment, a two-piece spill proof open cup comprises a lid and a container suitable for holding liquids. The lid has an upper surface, a lower surface, a flap, a lid body, a hinge connecting the flap to the lid body, a handle on the upper surface, a vent and a bead having channels. The bead is integrated into the lower surface. The container has a sidewall, a neck adjacent the sidewall and an opening defined by the neck. The sidewall has a seat and a shoulder adjacent the seat. The seat is adapted to receive the bead. The neck has a flange along an edge of the neck and a plurality of posts adjacent the flange. The posts are positioned along the edge of the neck so that the hinge rests on the posts when the lid is attached to the container. In another embodiment, the vent is a slit.

The advantages of the two-piece spill proof open cup of the present invention include elimination of a complex valve structure by providing an uncomplicated structure that is easy to clean. Another advantage of the two-piece spill proof open cup of the present invention includes a tight seal between the lid and container so that the liquid contents will not spill out. Another advantage is the lid and container are shaped so that they more closely conform to the shape of a user's mouth creating a more ergonomic and comfortable drinking experience by the user. Another advantage is that the cup can be used as a regular open cup when the lid is removed. Another advantage is that a user does not have to elevate the cup much more than a horizontal angle formed between the cup and the user avoiding the need for an awkward drinking angle. Another advantage is that the entire cup is comprised of only two parts—a lid and a container making for ease of assembly by both the manufacturer and consumer. These and other advantages will be readily apparent from the drawings and detailed description that follows.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF EMBODIMENTS

Figure 1:
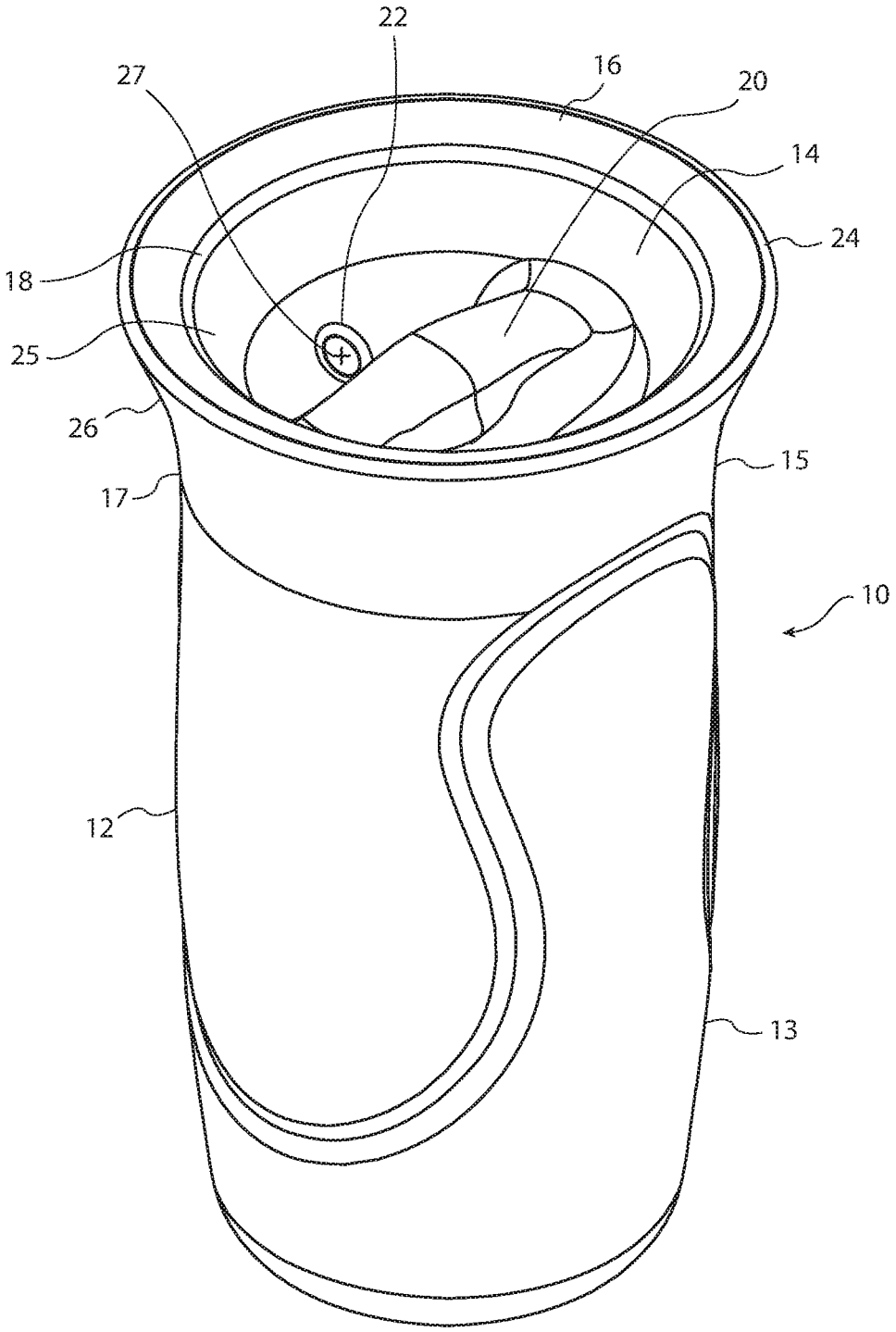
FIG. 1 is a perspective view of a two-piece spill proof open cup of the present invention.

Reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

Referring to FIG. 1, a perspective view of a two-piece spill proof open cup of the present invention, two-piece spill proof open cup 10 is shown having container 12 capped or fastened to lid 14. Container 12 has sidewall 13 and neck 15. Neck 15 is narrower at base 17 and flares out to lip 26. Adding the flare to lip 26 makes for a smaller drinking angle that provides a more ergonomic cup and a more comfortable drinking experience for a user. Rim 24 caps neck 15. Lid 14 has flap 16 and hinge 18 that connects flap 16 to lid body 25. Lid body 25 has handle 20 for easy removal of lid 14 from container 12. Also, lid body 25 has vent 22 with cross-slit 27 for allowing air to pass into container 12 when two-piece spill proof open cup 10 is used for drinking.

Figure 2:
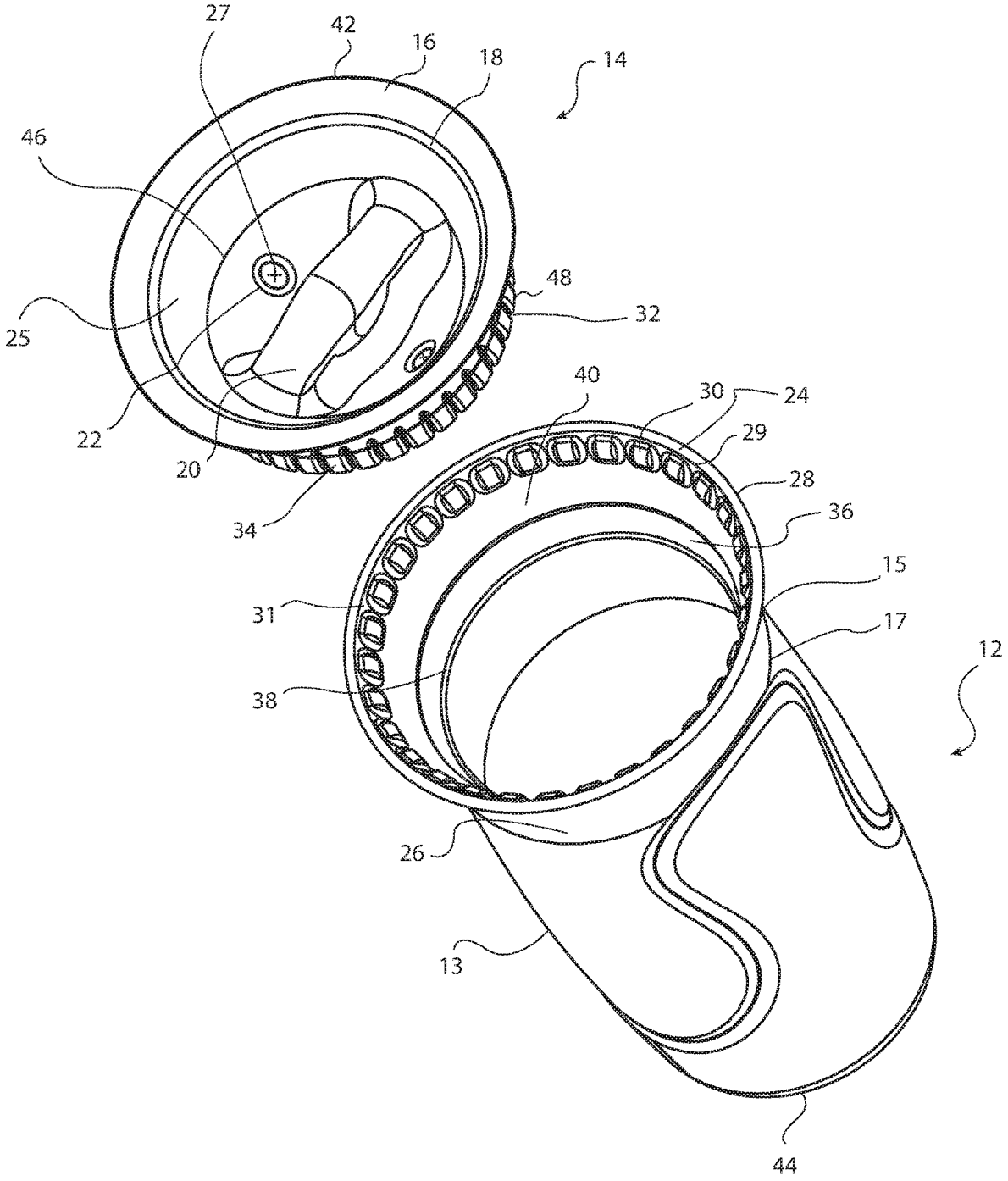
FIG. 2 is an exploded perspective view of the two components of the two-piece spill proof open cup of the present invention shown in FIG. 1.

Referring to FIG. 2, an exploded perspective view of the two components of the two-piece spill proof open cup of the present invention shown in FIG. 1, container 12 is shown in the open condition suitable for receiving a liquid or beverage. Container 12 is typically a unibody construction made of a thermoplastic such as polypropylene or Triton having sidewall 13 and bottom 44. Adjacent to sidewall 13 opposite bottom 44 is neck 15 defining opening 40. In the preferred embodiment, neck 15 has base 17 forming a concave curved lip 26 in neck 15 matching the curve of lid body 25 so that it more closely matches the convex protrusion of a user's mouth to provide a more ergonomic structure and more comfortable drinking experience. Neck 15 has flange 28, that includes rim 24 and neck edge 29, for receiving flap 16 of lid 14. As explained in more detail below, the diameters of neck 15 along neck edge 29 of container 12 and flap 16, along flap edge 42, of lid 14 are selected so that when lid 14 is fastened to container 12, flap 16 is loaded against flange 28. In the preferred embodiment, flap edge 42 coincides with neck edge 29 forming a tight seal between lid 14 and container 12 so that should two-piece spill proof open cup 10 tip over, the liquid or beverage will not spill out. Adjacent flange 28 are posts 30 arranged so that there are conduits 31 allowing the beverage to flow between adjacent posts. Posts 30 are also arranged so that hinge 18 of lid 14 is positioned adjacent posts 30 providing a base for hinge 18 which acts as a fulcrum to flap 16. In the preferred embodiment, there is a small gap between hinge 18 and posts 30. In other embodiments, hinge 18 may rest upon posts 30. In the preferred embodiment, in neck 15 below posts 30 is seat 36. Seat 36 is adapted to receive bead 34 in a press fit arrangement so that when bead 34 is fitted into seat 36, lid 14 is tightly fastened to container 12. Shoulder 38 is provided to offer additional support to bead 34.

Still referring to FIG. 2, lid 14 has upper surface 46 and lower surface 48. When lid 14 is fastened to container 12, upper surface 46 is exposed to a user while lower surface 48 is directed internal to container 12 and any beverage therein. Lid body 25 in upper surface 46 generally follows the contour of lip 26. The complimentary shapes of lid body 25 and lip 26 permit the entire contents of container 12 to pass out of two-piece spill proof open cup 10 without the user having to elevate the cup at an awkward angle. On upper surface 46, there is handle 20 for easy installation and removal of lid 14 from container 12. Container 12 is also capable of use as a regular cup with the attachment of lid 14. Lid 14 is further comprised of lid body 25 that is connected to flap 16 by hinge 18. Vents 22 having slits 27 are formed in lid body 25. Alternatively, vents 22 could be duck bills or other suitable vents known to those skilled in the art. In the preferred embodiment, flap 16 is thinner than either hinge 18 or lid body 25 so that it moves freely under pressure when in the drinking mode. Bead 34 is formed in lower surface 48. Bead 34 serves the function of fastening lid 14 to container 12 when bead 34 is press fit into seat 36 of container 12 and forming a tight connection. Channels 32 are formed in bead 34 so that the beverage in container 12 can flow through bead 34 despite the tight connection.

Figure 3A:
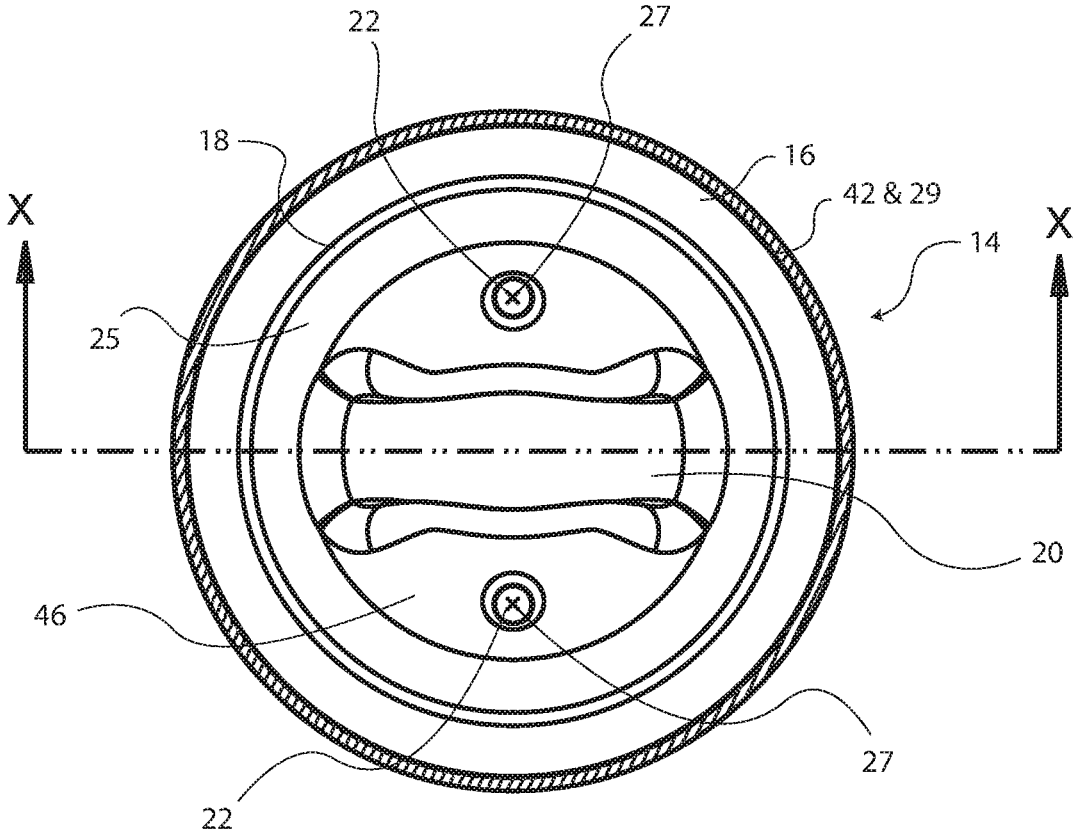
FIG. 3A is a top view of an embodiment of the two-piece spill proof open cup of the present invention.
Figure 3B:
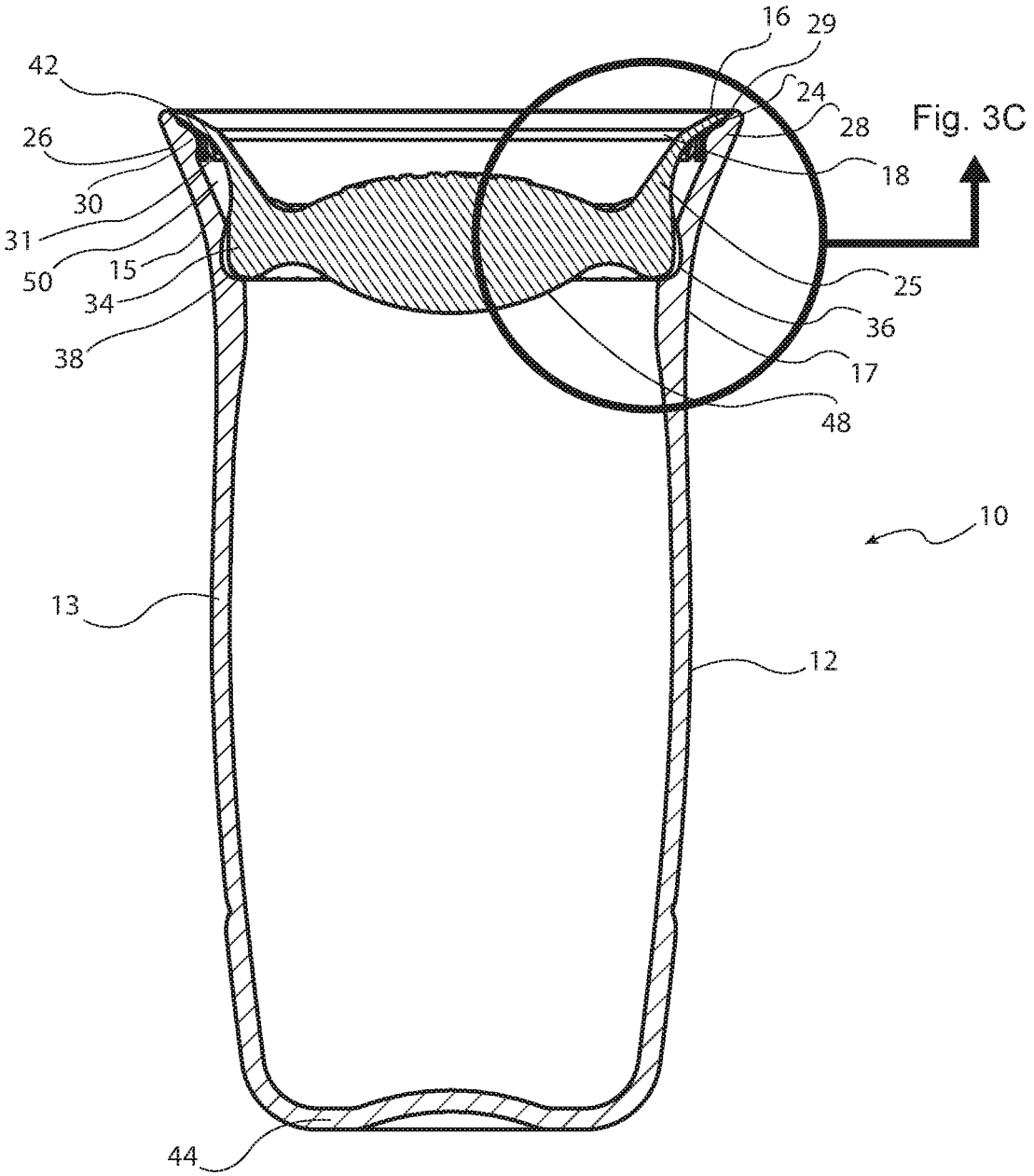
FIG. 3B is a sectional view of the two-piece spill proof open cup shown in FIG. 3A along the line X-X.

Referring to FIGS. 3A and 3B, respectively a top view of an embodiment of the two-piece open cup of the present invention and a sectional view of the two-piece spill proof open cup shown in FIG. 3A along the line X-X, lid 14 is fastened to container 12 so that upper surface 46 is exposed. Flap 16 rests along flange 28 and adjacent to rim 24 abutting neck edge 29 so that flap edge 42 is loaded against neck edge 29 creating a liquid tight seal between lid 14 and container 12 at flange 28. Flap 16 can move along hinge 18, attached to lid body 25, when a user drinks from two-piece spill proof open cup 10 and lifts flap 16 away from flange 28 allowing the liquid or beverage to flow out of the two-piece spill proof open cup 10. Hinge 18 may rest on posts 30 or be positioned slightly above posts 30 creating a small gap between hinge 18 and posts 30. But in either case posts 30 may act as a fulcrum for flap 16 when the user drinks from two-piece spill proof open cup 10. Posts 30 have conduits 31 that permit the beverage to flow from container 12 through flap 16 when the user places his or her lip on the upper surface 46 of lid 14 and drinks from two-piece spill proof open cup 10. Conduits 31 are sufficiently large to allow fluid to flow through them and are easy to clean. Upper surface 46 has vents 22 with slits 27 constructed therein. Lip 26 of neck 15 is shown with a concave flair arising out of base 17 to better match a user's mouth. Lower surface 48 has bead 34 resting in seat 36 and on shoulder 38. Channels 32 in bead 34 are obscured in this view but provide for direct fluid flow between container 12 into chamber 50. Like conduits 31, channels 32 are sufficiently large to allow fluid to flow through them and are easy to clean. The beverage then flows from chamber 50 thorough conduits 31 between posts 30 through flap 16 out of two-piece spill proof open cup 10.

Figure 3C:
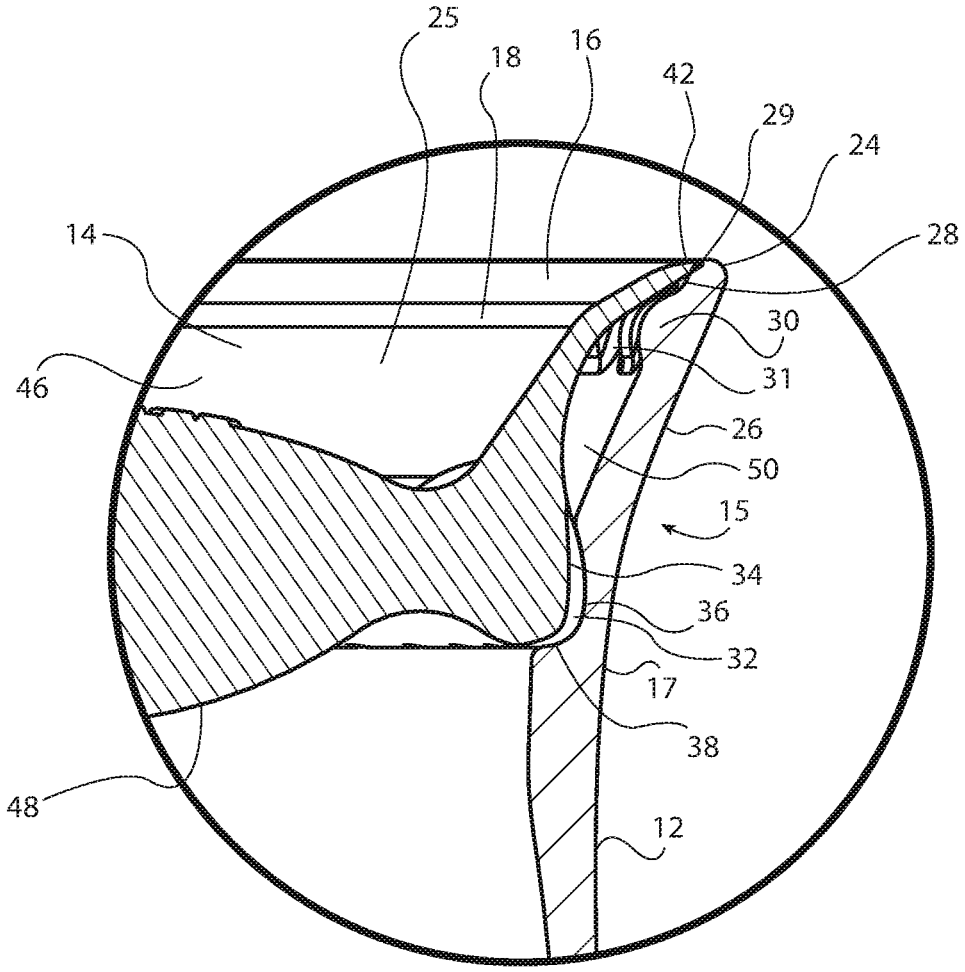
FIG. 3C is a more detailed view of the section circled in FIG. 3B.

Referring to FIG. 3C, a more detailed view of the section circled in FIG. 3B, container 12 is shown with seat 36 having shoulder 38 for supporting bead 34. Seat 36, in one embodiment, is positioned adjacent base 17 of neck 15. Lip 26 is shaped into neck 15 above base 17 and below flange 28 to provide a more ergonomic and comfortable drinking experience. Lid 14 is shown with lid body 25 connected to flap 16 by hinge 18. At the end of flap 16 is flap edge 42 that is loaded against neck edge 29 at rim 24 of flange 28. Hinge 18 may be supported by posts 30 or there may be a small gap between hinge 18 and posts 30. Between each post 30 is conduit 31 for conducting the beverage from chamber 50. When a user places his or her upper lip on lid body 25 of upper surface of lid 14, that places a downward pressure on lid body 25 that causes flap 16 to lift away from posts 30, through the operation of hinge 18, allowing the beverage to flow through the channels 32 of bead 34 into chamber 50 and then through conduits 31 into the user's mouth. When the downward pressure on lid body 25 is removed, flap 16 returns to its resting position on flange 28. As explained in more detail with respect to FIG. 3D, because the outside diameter $D_1$ of lid 14 along flap edge 42 is slightly larger than the inside diameter $D_2$ of container 12 along neck edge 29, flap 16 is loaded against neck edge 29 and rim 24 of flange 28 creating a tight liquid seal between lid 14 and container 12 so that the beverage will not spill out from two-piece spill proof cup should it be tipped over.

Figure 3D:
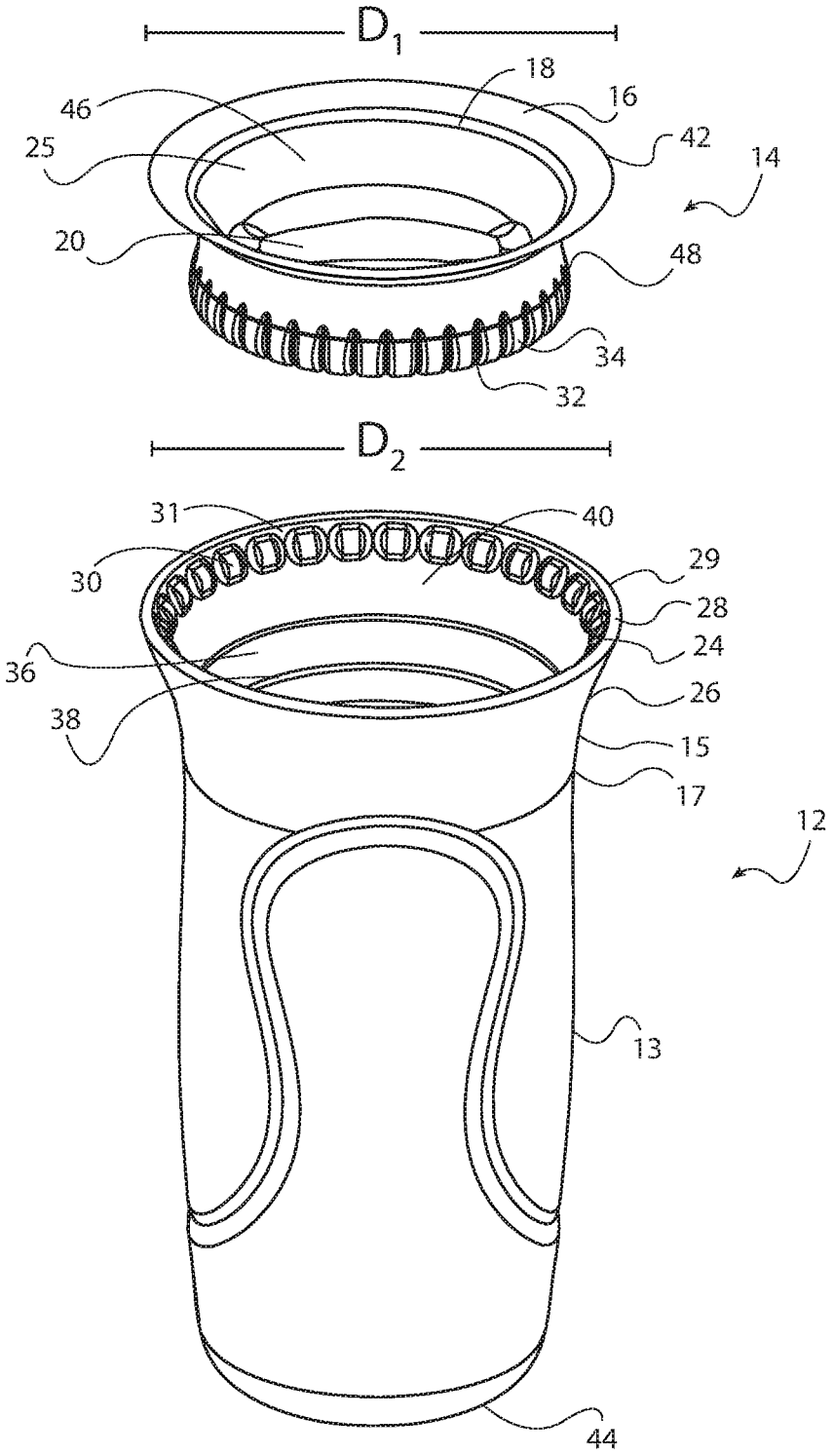
FIG. 3D is another perspective view of a two-piece spill proof open cup of the present invention.

Referring to FIG. 3D, another perspective view of a two-piece spill proof open cup of the present invention, lid 14 is shown having outside diameter $D_1$ and container 12 is shown having inside diameter $D_2$ such that $D_1$ is slightly larger than $D_2$. More particularly, $D_1$ is the diameter of lid 14 at flap edge 42 and $D_2$ is the diameter of container 12 at neck edge 29 of flange 28. Because the outside diameter $D_1$ of lid 14 along flap edge 42 is slightly larger than the inside diameter $D_2$ of container 12 along neck edge 29, flap 16 is loaded against neck edge 29 and rim 24 of flange 28 creating a tight liquid seal between lid 14 and container 12 so that the beverage will not spill out from two-piece spill proof cup should it be tipped over. The other features of container 12 and lid 14 are fully described in the other figures.

Figure 4A:
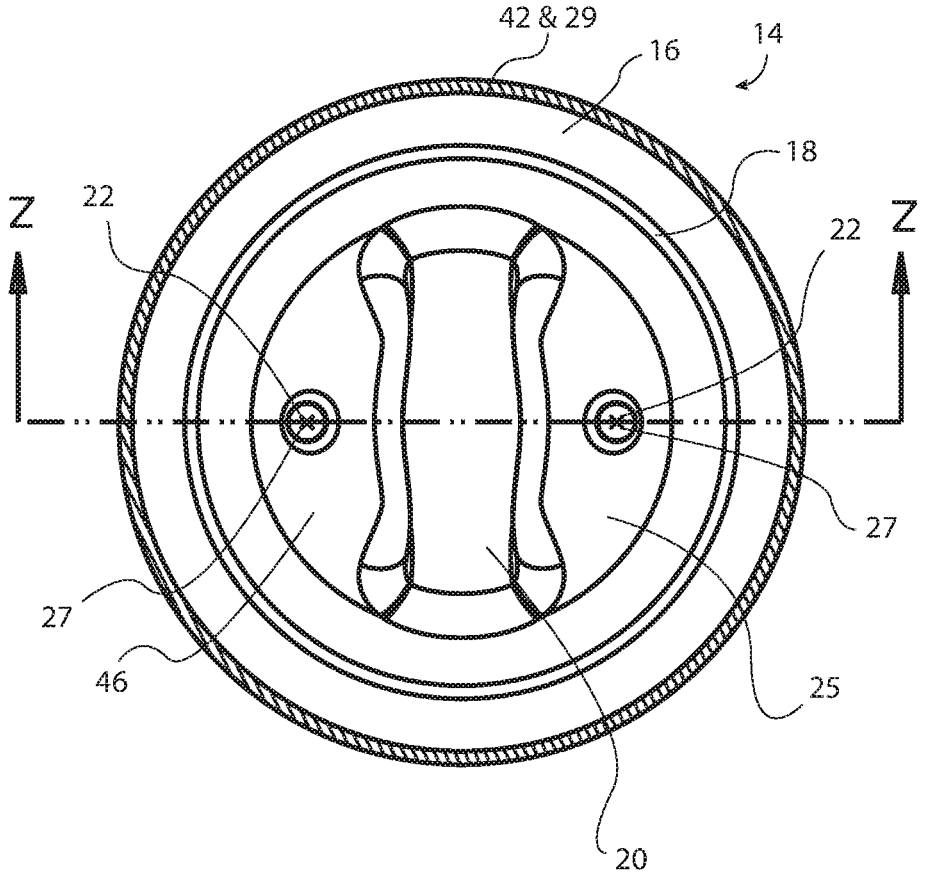
FIG. 4A is a top view of an embodiment of the two-piece spill proof open cup of the present invention.
Figure 4B:
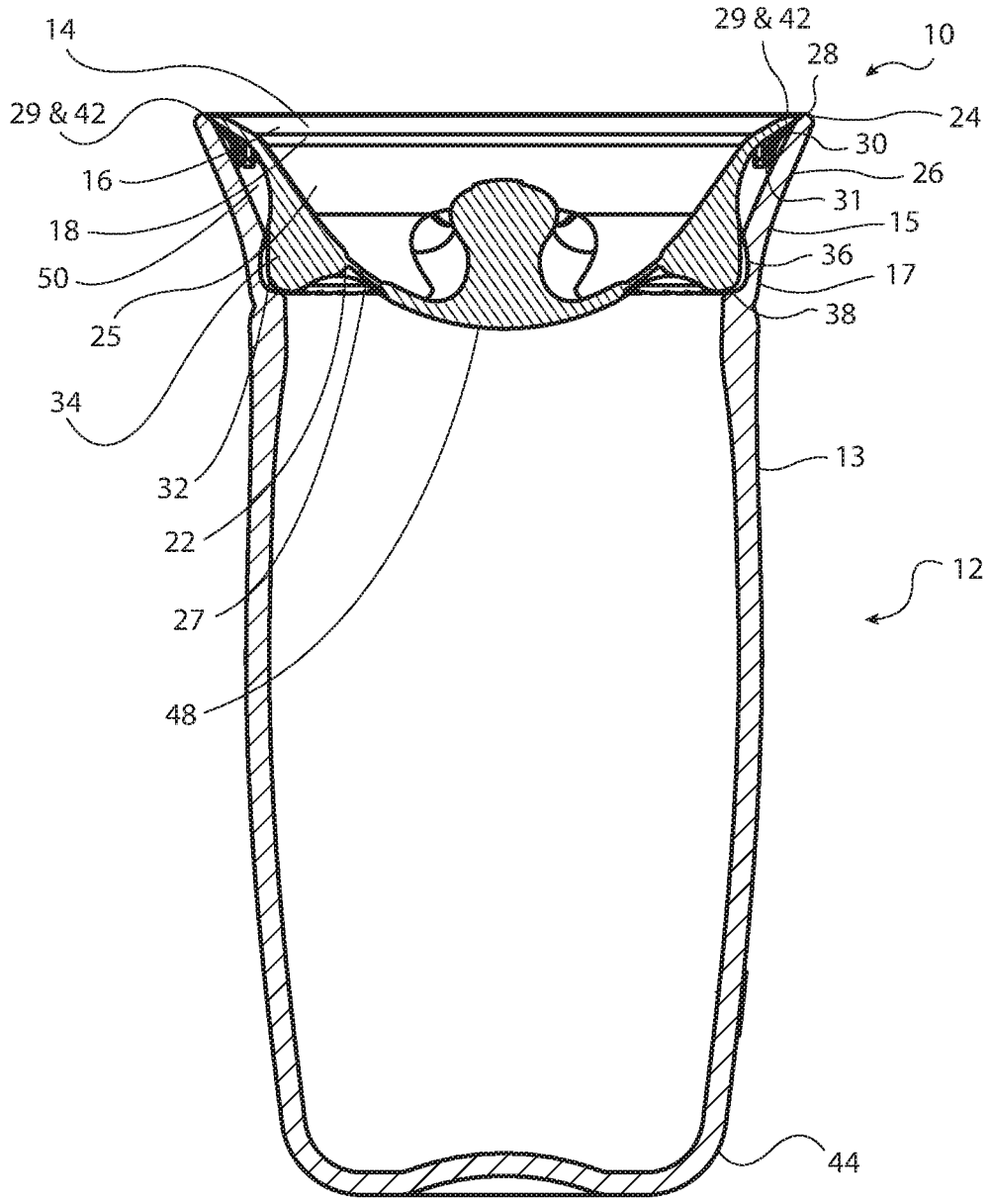
FIG. 4B is a sectional view of the two-piece spill proof open cup shown in FIG. 4A along the line Z-Z.

Referring to FIGS. 4A and 4B, respectively a top view of an embodiment of the two-piece spill proof open cup of the present invention and a sectional view of the two-piece spill proof open cup shown in FIG. 4A along the line Z-Z, container 12 is shown with sidewall 13, bottom 44 and neck 15 terminating at neck edge 29 and rim 24 of flange 28. Neck 15 of container 12 has an inside diameter $D_2$. Inside neck 15 and below rim 24 are posts 30 separated by conduits 31. Neck 15 of container 12 begins at base 17 and from base 17 flairs out to form lip 26. In the preferred embodiment, at base 17, seat 36, with shoulder 38, is provided for receiving bead 34. In lower surface 48 of lid 14 vents 22 with slits 27 are provided for allowing air to move in and out of two-piece spill proof open cup 10. Bead 34 has channels 32 formed throughout to provide unrestricted fluid flow. Lid body 25 connects to flap 16 along hinge 18. Hinge 18 may be supported by posts 30. Flap edge 42 sits along neck edge 29 of rim 24 of flange 28. In the preferred embodiment, the inside diameter $D_2$ of neck 15 at neck edge 29 is slightly smaller than the outside diameter $D_1$ of lid 14 at flap edge 42 so that flap 16 is loaded against rim 24 of flange 28 creating a liquid tight seal. Chamber 50 is formed between bead 34 and posts 30.

Figure 5:
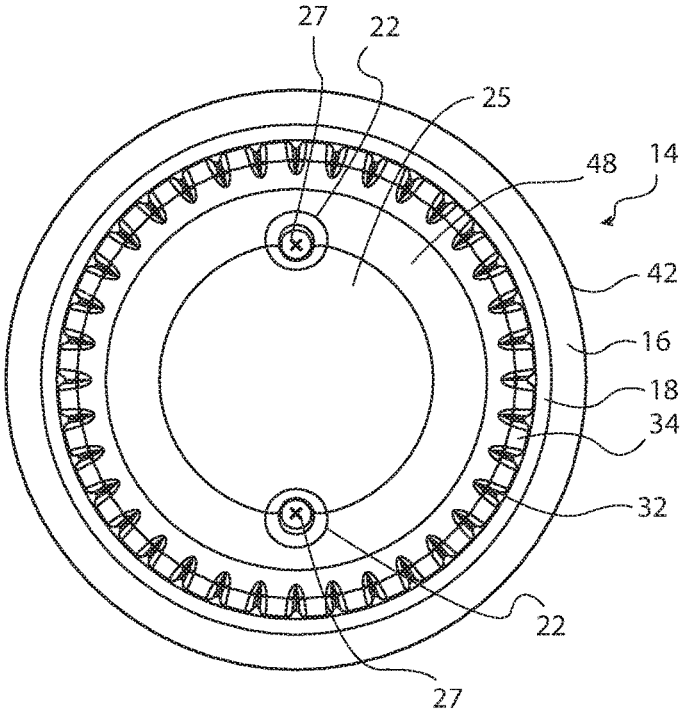
FIG. 5 is a bottom view of a lid useful in an embodiment of the present invention.
Figure 6:
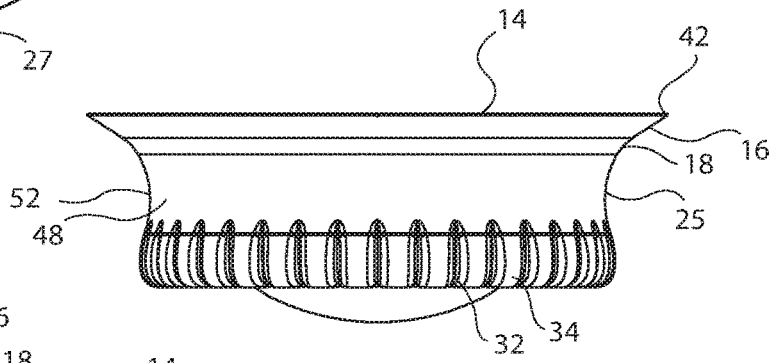
FIG. 6 is a side view of a lid useful in an embodiment of the present invention.
Figure 7:
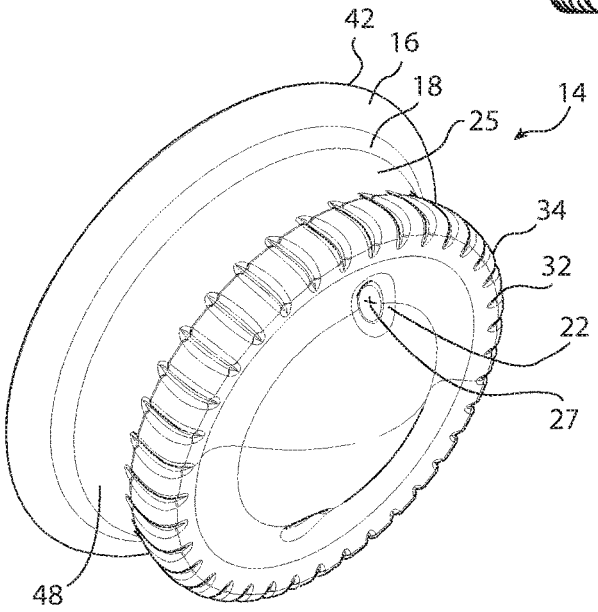
FIG. 7 is a bottom perspective view of a lid useful in an embodiment of the present invention.

Referring to FIGS. 5-7, respectively a bottom view, a side view and a bottom perspective view of a lid useful in an embodiment of the present invention, lid 14 is shown with lid body 25 having vents 22 with slits 27. Under surface 48 has bead 34 with alternating channels 32. In the preferred embodiment, channels 32 are V-shaped but other configurations are within the scope of the invention. Outer wall 52 is constructed to compliment neck 15 so that a chamber 50 is created between bead 34 and posts 30. Hinge 18 connects lid body 25 to flap 16 that terminates at flap edge 42. In the preferred embodiment, lid 14 is constructed of silicone.

Although exemplary embodiments have been shown and described, it will be clear to those of ordinary skill in the art that a number of changes, modifications, or alterations to the disclosure as described may be made. For example, container 12 can be formed in a shape other than a cylinder. Lid 14 can attach to neck 15 in a variety of way such as the use of threads or compression. In the event either threads or compression are used then there is no need for seat 36 and shoulder 38. Vent 22 can be constructed in different ways such as a duck bill valve as is well known to those skilled in the art. All such changes, modifications, and alterations should therefore be seen as within the scope of the disclosure.

What is claimed is:

1. A two-piece spill proof open cup comprising:

a container suitable for holding liquids, the container having a sidewall, a neck adjacent the sidewall, an opening defined by the neck; the neck having a flange along an edge of the neck and a plurality of posts adjacent the flange;

a lid adapted to fasten to the container, the lid having an upper surface external to the two-piece spill proof open cup, a lower surface internal to the two-piece spill proof open cup, a flap, a lid body, a hinge connecting the flap to the lid body, a handle on the upper surface, and a bead having channels wherein the bead is integrated into the lower surface.

2. The two-piece spill proof open cup of claim 1 wherein the container has an inside diameter and the lid has an outside diameter and the outside diameter is slightly larger than the inside diameter.

3. The two-piece spill proof open cup of claim 1 wherein the flap is constructed so that it is loaded against the flange.

4. The two-piece spill proof open cup of claim 1 wherein the lid is constructed of an elastomeric material.

5. The two-piece spill proof open cup of claim 1 wherein the container is constructed of a thermoplastic material.

6. The two-piece spill proof open cup of claim 1 wherein the lid is constructed of silicone.

7. A two-piece spill proof open cup comprising:

a lid having an upper surface, a lower surface, a flap, a lid body, a hinge connecting the flap to the lid body, a handle on the upper surface, and a bead having channels wherein the bead is integrated into the lower surface;

a container suitable for holding liquids, the container having a sidewall, a neck adjacent the sidewall, an opening defined by the neck; the sidewall having a seat and a shoulder adjacent the seat, the seat is adapted to receive the bead, the neck having a flange along an edge of the neck and a plurality of posts adjacent the flange, the posts positioned along the edge of the neck so that the hinge rests on the posts when the lid is attached to the container.

8. The two-piece spill proof open cup of claim 7 wherein the lid body further comprises a vent.

9. The two-piece spill proof open cup of claim 7 wherein the flap is constructed so that it is loaded against the flange.

10. The two-piece spill proof open cup of claim 7 wherein the container has an inside diameter and the lid has an outside diameter and the outside diameter is slightly larger than the inside diameter.

11. The two-piece spill proof open cup of claim 7 wherein the lid is constructed of an elastomeric material.

12. The two-piece spill proof open cup of claim 7 wherein the container is constructed of a thermoplastic material.

13. The two-piece spill proof open cup of claim 8 wherein the lid is constructed of silicone.

14. A two-piece spill proof open cup comprising:

a lid having an upper surface, a lower surface, a flap, a lid body, a hinge connecting the flap to the lid body, a handle on the upper surface, a vent and a bead having channels wherein the bead is integrated into the lower surface;

a container suitable for holding liquids, the container having a sidewall, a neck adjacent the sidewall, an opening defined by the neck; the sidewall having a seat and a shoulder adjacent the seat, the seat is adapted to receive the bead, the neck having a flange along an edge of the neck and a plurality of posts adjacent the flange, the posts positioned along the edge of the neck so that the hinge rests on the posts when the lid is attached to the container.

15. The two-piece spill proof open cup of claim 14 wherein the container has an inside diameter and the lid has an outside diameter and the outside diameter is slightly larger than the inside diameter.

16. The two-piece spill proof open cup of claim 14 wherein the flap is constructed so that it is loaded against the flange.

17. The two-piece spill proof open cup of claim 14 wherein the lid is constructed of an elastomeric material.

18. The two-piece spill proof open cup of claim 14 wherein the container is constructed of a thermoplastic material.

19. The two-piece spill proof open cup of claim 14 wherein the lid is constructed of silicone.

20. The two-piece spill proof open cup of claim 14 wherein the vent is a slit.

* * * * *